US008043143B2

(12) United States Patent
Elek et al.

(10) Patent No.: US 8,043,143 B2
(45) Date of Patent: Oct. 25, 2011

(54) SHARPENERS TO CREATE CROSS-GRIND KNIFE EDGES

(75) Inventors: Bela Elek, Wilmington, DE (US); Daniel D. Friel, Sr., Greenville, DE (US); Daniel D. Friel, Jr., Kennett Square, PA (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 12/845,961

(22) Filed: Jul. 29, 2010

(65) Prior Publication Data

US 2011/0034111 A1 Feb. 10, 2011

Related U.S. Application Data

(60) Provisional application No. 61/232,065, filed on Aug. 7, 2009.

(51) Int. Cl.
*B24B 3/36* (2006.01)

(52) U.S. Cl. ..... 451/349; 76/82.2

(58) Field of Classification Search ..... 451/349; 76/82.2, 85, 87

See application file for complete search history.

(56) References Cited

U.S. PATENT DOCUMENTS

| | | | | | |
|---|---|---|---|---|---|
| 2,860,452 | A | * | 11/1958 | Lebus | 451/241 |
| 3,032,938 | A | * | 5/1962 | Voll | 451/549 |
| 3,334,446 | A | * | 8/1967 | Jager | 451/282 |
| 4,468,894 | A | | 9/1984 | Hong | |
| 4,627,194 | A | | 12/1986 | Friel | |
| 4,672,778 | A | * | 6/1987 | Rieser | 451/486 |
| 4,716,689 | A | | 1/1988 | Friel | |
| 4,723,375 | A | | 2/1988 | Linden | |
| 4,807,399 | A | * | 2/1989 | Friel | 451/45 |
| 4,897,965 | A | | 2/1990 | Friel | |
| 4,915,709 | A | * | 4/1990 | Andrew et al. | 451/259 |
| 5,005,319 | A | | 4/1991 | Friel | |
| 5,148,634 | A | | 9/1992 | Bigliano | |
| 5,245,791 | A | | 9/1993 | Bigliano | |
| 5,390,431 | A | | 2/1995 | Friel | |
| 5,404,679 | A | | 4/1995 | Friel | |
| 5,449,315 | A | | 9/1995 | Friel | |
| 5,582,535 | A | | 12/1996 | Friel | |
| 5,611,726 | A | * | 3/1997 | Friel et al. | 451/177 |
| 5,868,611 | A | | 2/1999 | Friel | |
| 6,012,971 | A | * | 1/2000 | Friel et al. | 451/45 |
| 6,113,476 | A | | 9/2000 | Friel | |
| 6,267,652 | B1 | | 7/2001 | Friel | |

(Continued)

FOREIGN PATENT DOCUMENTS

DE 3422882 2/1986

*Primary Examiner* — Maurina Rachuba

(74) *Attorney, Agent, or Firm* — Connolly Bove Lodge & Hutz LLP

(57) ABSTRACT

A sharpener for creating cross-grind knife edges includes a nominally flat annular abrasive sharpening member which could be a ring or a disk and is rotated about its center and held against a moving knife edge facet to simultaneously and sequentially abrade the knife edge at multiple locations on the abrasive member. The disk may be slidably mounted on a shaft in opposition to a spring restraining force. The disk is nominally disposed in a vertical orientation. The sharpener may include multiple stages including a manual stage having a pair of off axis conical shaped rotatable abrasive coated disks which have abrading lines on opposing facets which are not parallel but cross and intersect in a crossing pattern at the blade edge.

9 Claims, 6 Drawing Sheets

U.S. PATENT DOCUMENTS

| | | | | |
|---|---|---|---|---|
| 6,726,551 | B2 | 4/2004 | Friel | |
| 6,802,763 | B1 * | 10/2004 | Leung | 451/267 |
| 6,863,600 | B2 * | 3/2005 | Friel, Sr. | 451/293 |
| 6,875,093 | B2 | 4/2005 | Friel | |
| 6,881,137 | B2 | 4/2005 | Friel | |
| 6,997,795 | B2 | 2/2006 | Friel | |
| 7,172,499 | B2 * | 2/2007 | Eklund | 451/261 |
| 7,235,004 | B2 * | 6/2007 | Friel et al. | 451/198 |
| 7,287,445 | B2 | 10/2007 | Friel | |
| 7,452,262 | B2 | 11/2008 | Friel | |
| 7,488,241 | B2 | 2/2009 | Elak | |
| 7,494,403 | B2 | 2/2009 | Friel | |
| 7,517,275 | B2 | 4/2009 | Friel | |
| 7,686,676 | B2 | 3/2010 | Friel | |
| 2009/0233530 | A1 | 9/2009 | Friel | |

* cited by examiner

SHARPENERS TO CREATE CROSS-GRIND KNIFE EDGES

CROSS REFERENCE TO RELATED APPLICATION

This application is based on provisional application Ser. No. 61/232,065, filed Aug. 7, 2009, all of the details of which are incorporated herein by reference thereto.

BACKGROUND OF INVENTION

This disclosure describes unique powered and manual sharpening means using abrasives to rapidly create a highly effective cutting edge on knives and similar cutting blades. Much has been written about means to create extraordinarily sharp edges on knives by creating geometrically perfect facets on each side of a knife edge that meet with high precision to create edges only a few microns in width. Further advances have been made in the old art of steeling an edge using modern technology to create highly reproducible micro-serrated edges along an already sharpened edge. This disclosure is about a unique and highly effective knife edge structure and more specifically about novel sharpening means to create such structure.

In spite of the technical advances of the past 20 years, there remains a lot of art involved in creating a perfect cutting edge. Indeed the perfect edge for cutting one particular food or material can be judged to be very different from the ideal edge geometry for cutting another food or material. Further the optimum edge for cutting is dependent on whether the user is moving the blade with a cutting stroke or shearing stroke. A geometrically perfect edge is better for a shearing action as with an axe while a less perfect edge populated with unique edge irregularities has been shown by the inventors to perform better with a slicing stroke. The nature of those irregularities, their size, and population has been found to effect importantly the ease of cutting a wide variety of materials especially those of a fibrous or semi-fibrous nature.

SUMMARY OF INVENTION

These inventors have found that a highly effective knife edge for many culinary uses is one with unique micro-serrations along precisely formed facets that have been sharpened to create a series of very sharp micro-blades along the edge. An optimum cutting geometry is created by forming the irregularities at two distinctly different grinding angles on the same or opposing sides of the edge. This creates edge irregularities that are pointed in both directions first as seen by viewing perpendicular to the knife edge line but also as viewed sighting in line with the cutting edge. The irregularities thus formed at the edge are very sharp but in addition the grind lines each leave sharp flutes that extend from the fine micro-serrations onto the surface of the small supporting facets on each side of the edge. The flutes assist in cutting. This type of edge is highly effective irrespective of whether the knife is pushed or pulled through the material being cut.

In order to create this highly effective knife edge reproducibly, repeatedly, and quickly with high precision is extremely challenging. One can imagine procedures to accomplish this by solely manual means using sharpening stones and infinite patience, taking a variety of precisely orchestrated strokes in the proper sequence, while changing stones frequently. But that is truly impractical and very time consuming even for those highly skilled in manual sharpening. These inventors have shown that a unique combination of an electrically driven and a manual means can create this type edge consistently and rapidly, as disclosed here.

We have developed electrically powered sharpeners that can be used to create this specialized edge quickly, that can be followed by additional powered stages using finer abrasives to refine this geometry and sharpness of the structure created along the edge. Alternatively special manual sharpening means can be combined with these new electrical sharpeners to further refine the edge sharpness while maintaining this preferred edge structure and reducing the size of the edge structure. The combination of electrical and manual means is unique, surprisingly effective and a highly economical combination, resulting in a generally affordable means to sharpen a wide variety of knives leaving a very versatile multi-purpose cutting edge.

THE DRAWINGS

DETAILED DESCRIPTION

It is common practice when sharpening with conventional abrasive wheels to hold the metallic knife edge against a rotating abrasive wheel and to drive the abrasive in a specific single direction so that the abrasive surface is directed to move away from the knife edge as it is sharpened. That motion can under ideal conditions create a very thin, sharp, and uniform edge. When the sharpening abrasive is driven across the edge in the opposite direction, that is into the edge (not away from the edge), a highly distorted undesirable burr can be created along the edge facet, leaving a less desirable edge. The burr created by that reverse grinding motion we have shown can however be quickly removed by a few strokes where the abrasive moves away from the edge, removing the burr debris from the facets and edge, leaving an improved cutting edge.

Figure 1:
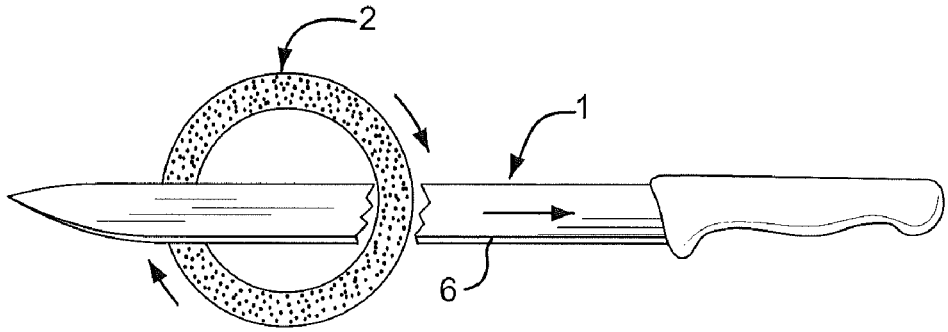
FIG. 1 is a perspective view showing a knife being sharpened by a flat sharpening member in accordance with this invention.
Figure 1A:
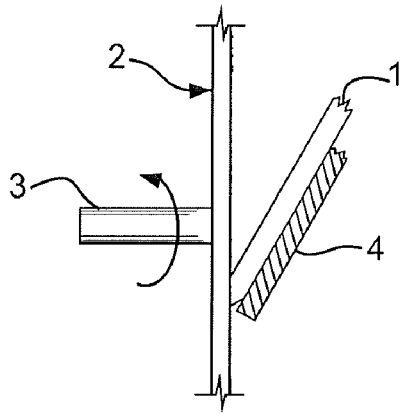
FIG. 1A is a side elevational view of the arrangement of FIG. 1.
Figure 2:
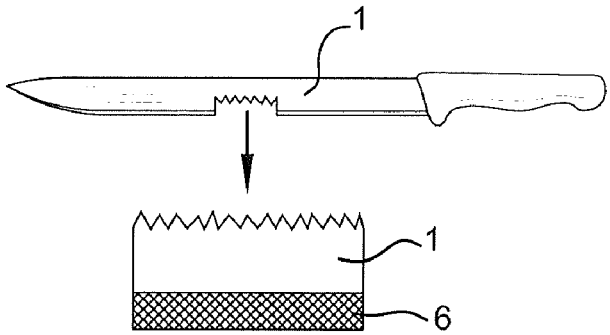
FIG. 2 illustrates a knife edge resulting from the sharpening techniques of FIGS. 1 and 1A.

The efficient powered sharpening means that has been developed by these inventors can create this improved type of edge repeatedly with high precision. It uses optimally a unique nominally flat annular abrasive ring 2 or disk-like abrasive surface (FIG. 1) rotated about its geometric center and pressed in contact with the edge facet 6 of the moving knife 1 so that sequentially the edge facet 6 contacts and is abraded at multiple radial locations as it crosses the rotating abrasive annular member. Ideally the annular member is small compared to the length of the knife edge in order that the entire knife edge facet can be abraded by the abrasive particles as they cross sequentially from different directions (FIG. 2) to form V patterned grooves meeting at the edge along facet 6. As the edge is pulled across the annular rotating abrasive surface, the rotating abrasives on the disk surface grind sequentially into and out of the knife edge. This leaves a series of unique crossing grind lines on the surface of edge facet 6 (FIG. 2). Ideally the knife edge facet is positioned to contact the rotating disk predominantly at those angular locations on the disk where the moving abrasive crosses the edge facet at an angle of about 30 to 70 degrees to the edge line. Depending on the exact angle of abrasive crossing, the microscopic irregularities along the edge itself, as seen in FIG. 2, will be larger or smaller and the durability of the cutting edge will be affected. An angle of about 45 degrees creates a very effective edge. The direction of rotation of the abrading disk and the direction of the hand sharpening stroke are best coordinated so that the edge at any location along the sharpened knife edge facet, as the knife is pulled thru the sharpener, is preferably sharpened first by moving abrasive into the edge line but finished with the abrasive moving out of the edge, so that any burr formed by abrasive action into-the-edge can be subsequently removed by action out-of-the-edge. It is very important that the knife angle guide 4 position the knife face precisely (FIG. 1A) in order that the plane of its edge facet is angularly positioned precisely with reference to the rotating plane of the abrasive sharpening disk 2. Commonly the plane of the cutting edge facets are each abraded at about 20° relative to the central plane of the blade thickness for Euro-American style blades and about 15° for Asian blades.

Figure 3:
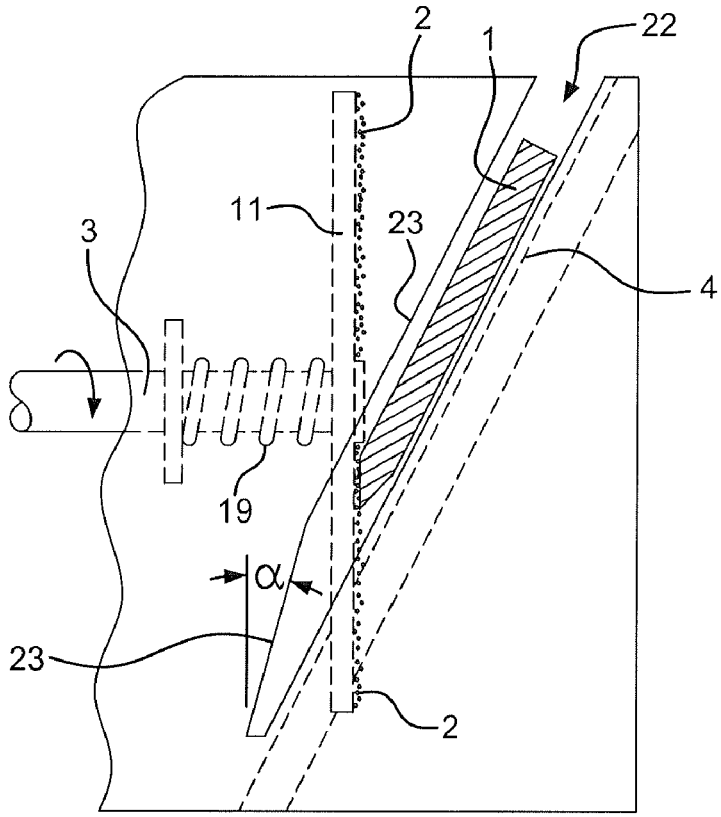
FIG. 3 is a side elevational view of a powered sharpening stage for producing a cross-grind knife edge in accordance with this invention, with a knife shown in initial contact with the abrasive disk.
Figure 3A:
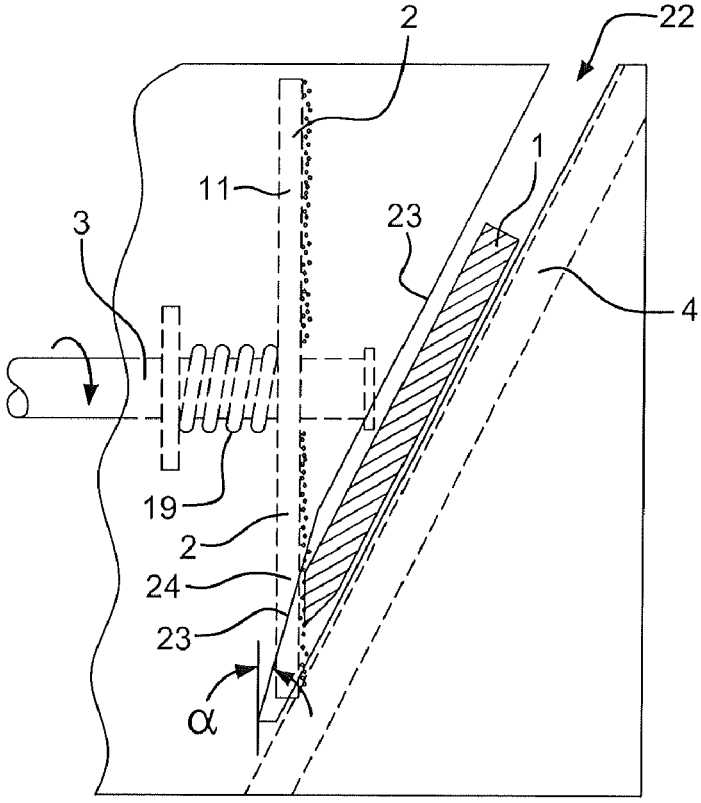
FIG. 3A is a modified view of FIG. 3 with a knife fully inserted and the disk displaced to the left.

An illustrative arrangement of a precision knife angle guide 4 and an abrasive surfaced annular disk 2 are shown in FIG. 3. Ideally the nominally flat rotating annular disk is mounted slidingly, but splined, onto a shaft 3 driven by a motor. (The splining is not shown.) The rest position of the vertical abrasive covered annular disk 2 is maintained by the force of spring 19 but ideally the rotating disk is mounted on a displaceable shaft or slidingly on the shaft, displaceable by the manual pressure applied to the knife as it is sharpened. The spring pressure determines and limits the amount of force on the edge facet. The knife guide 4 is for example positioned at an angle of about 20° to the plane of the rotating disk. It is designed so that the face of the knife 1 can be hand held against it and moved slidingly in continuous intimate contact with its surface. The plane of the upper edge facet along the knife edge intended to be sharpened at 20°, will thus be positioned nominally vertical as it contacts the surface of the rotating abrasive disk. The knife 1 is confined to slide within the slot 22 with the lower knife face in contact with the upper surface of angle guide 4. The upper wall 23 of slot 22 at location 24 is set at an angle alpha, $\alpha$, relative to the plane (shown vertical) of the rotating abrasive surface. The upper physical wall 23 of the knife slot at location 24 in the vicinity of the abrasive coated disk, located near the bottom of that slot is set at that angle $\alpha$ to the vertical so that the sharp knife edge will not contact it (see FIG. 3A), however that portion of the wall of the knife guide slot will act against the shoulder of the edge facet to prevent further descent of the blade as the knife is pressed manually down the slot. The upper wall of the knife slot at location 24 will thus touch the blade only at the shoulder of the edge facet where the upper edge facet meets the face of the blade. If the plane of the rotating abrasive disks is vertical, the angle $\alpha$ must be finite which will lean the upper wall clockwise beyond vertical to ensure that the knife edge will not contact the upper wall of the guiding slot. With this configuration the upper edge of the slot at location 24 will stop the blade but it will not contact and consequentially will not damage the cutting edge itself. As the knife face, resting against its angle guide, is slid manually down the guide 4 toward the disk surface (FIG. 3A), the knife edge facet will first contact the rotating disk and as the knife is pressed down further into the slot the abrasive disk is displaced parallel on its drive shaft until the shoulder of the blade edge facet contacts the upper surface 23 of the knife slot which prevents further descent of the knife without damaging the edge. With the edge facet then securely in contact with the rotating disk the facet angle will be ground to the selected angle, for example in this case at 20°. This is a novel means of controlling the knife sharpening angle while utilizing the guiding knife slot wall to limit further descent of the knife so that the sharp edge itself is not damaged in any way as it is sharpened. Thus, in this unique design the knife slot wall 23 can be made of metal so that it will not wear significantly as it is rubbed repeatedly by the moving blade but this unique design prevents damage to the knife edge. The restraining spring 19 serves to control the pressure of the abrasive against the facet and consequentially the sharpening force is never so great as to gouge the knife edge. This unique physical arrangement can be duplicated in a left slot, in a mirrored configuration, so that the knife edge can be sharpened sequentially in a pair of left and right knife slots, thus safely grinding both the left and right edge facets of a knife at the selected angle.

Thus, as illustrated and described above, the guiding slot 22 extends downwardly and inwardly from the top surface of the cover structure. The knife blade is disposed against a surface of a first wall at slot 22 while location 24 is at a second wall 23 of slot 22 spaced from the first wall. Location 24 comprises stop structure to prevent further descent or insertion of the knife blade into slot 22.

The rotating annular disk is designed so that it can move slidingly and linearly along its drive shaft or it can be fastened rigidly to a rotating drive shaft which can be displaced against the force of a restraining spring as the knife edge facet moves down the slot into secure contact with the disk. The knife edge, either straight or slightly convex along its cutting length, will remain always in good contact with the disk with a force during sharpening established and limited by the tension of the restraining spring. The depth of grooves cut into the edge facet will be related to the size of abrasive grit used, the spring force and the linear velocity of the driven abrasive particles. The user places the blade in the guide with its face in continuous sliding contact with the guide surface and presses the knife down the guide surface until the edge facet makes audible contact with the rotating sharpening disk. When resistance from the stopping structure at location 24 is felt, the knife is then pulled along its full length as its edge facet is sharpened. This process optimally is repeated alternately in a right and left sharpening configuration until both of the edge facets of a conventional knife are fully formed. All risks of edge gouging or knife damage are eliminated, there is no damage otherwise to the knife or sharpener, and the unique micro structure is imparted to the blade edge.

By this design and sharpening action the first edge facet is sharpened with a crossing grind pattern as shown in FIG. 2. The knife is moved then to the opposite handed guide (not shown) where a similar cross-grind pattern is created on the other facet, leaving a sharp edge with a minute sharp micro-serration along its length. The sharpening grooves and their associated flutes extend fully to the edge. A single powered sharpening stage as referred to here would in one configuration have two sharpening slots each with its own flat abrasive annular disk and a knife guiding means, thus providing a right configuration and a left configuration to sharpen successively the left and right facets adjacent the edge.

The unique powered annular abrasive disk configuration described above can be duplicated in a second sharpening stage (consisting of a left and right sharpening configuration) using finer abrasive grits on the second flat annular abrasive disks and using springs of perhaps lower force. In such a second stage the sharpening angle may be increased slightly to say about 22° (following 20° in the first stage) to establish a strong double beveled facet which will be extremely sharp with added durability that will retain its sharpness longer than if only a single lower angle bevel were on the facets. A third sharpening stage of similar paired design can be added with ultra fine diamonds to achieve edges of even greater sharpness and durability creating a multistage electric sharpener where the highest edge performance is desired.

Where two or more stages are employed in series in a single sharpener to develop this cross-grind edge as described it is ideal to use powered stages that easily and quickly create this cross-grind pattern using the flat annular abrasive disks. We know of no other powered sharpening means to create this novel edge geometry along a knife edge.

Manual Means to Create Similar Cross-Grind Edge Structure

Figure 4:
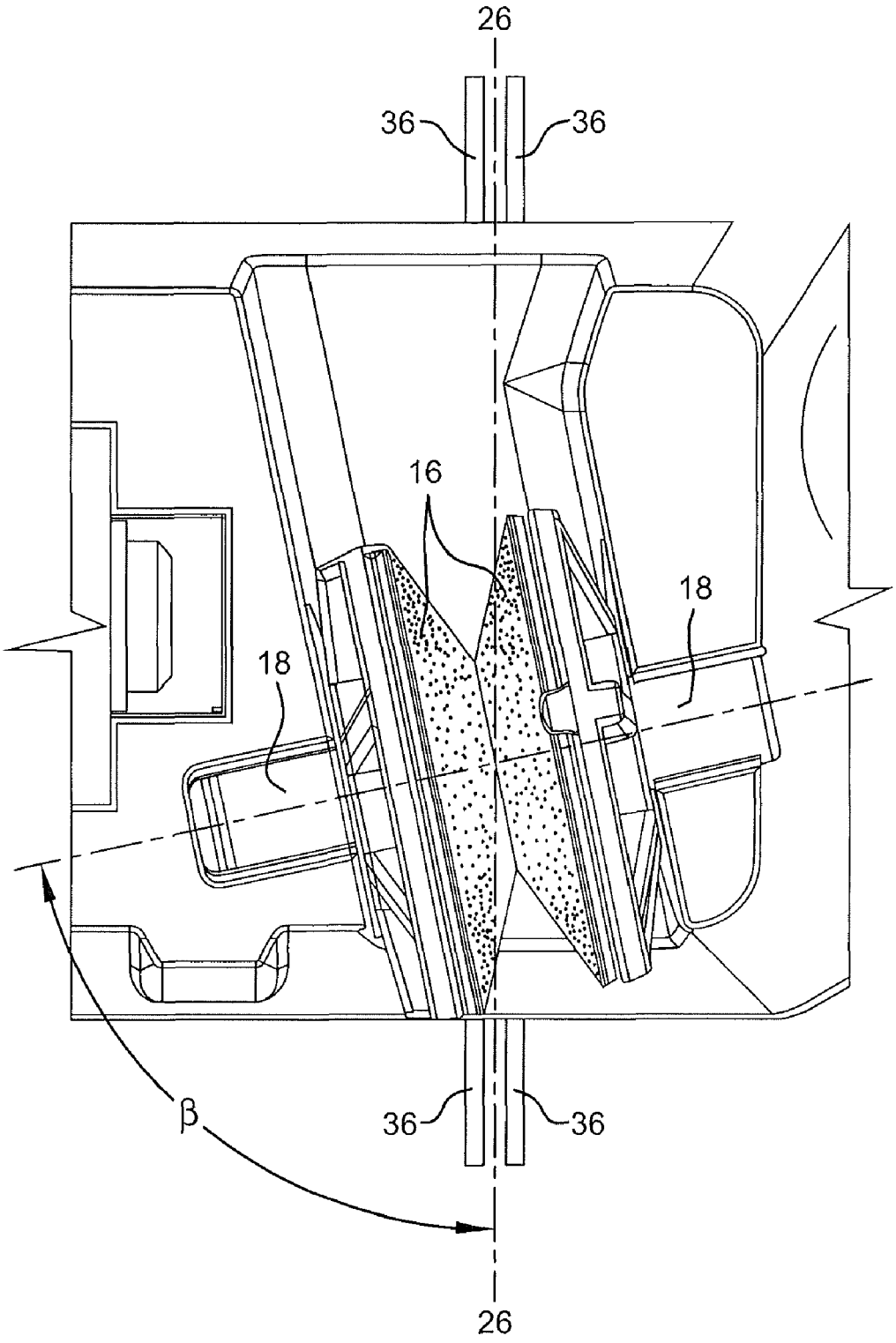
FIG. 4 illustrates a manual cross-grind sharpening stage in accordance with this invention.

One particularly effective manual means that we have found to be optimal in combination with one or more powered sharpening stations to place a final cross grind structure along a knife edge is shown in FIG. 4. This manual means can sharpen very rapidly although slightly slower than a power driven flat annular abrasive disk. Speed becomes particularly important when sharpening thick knives, very dull knives, knives previously sharpened at large facet angles, or knives sharpened previously by manual steeling—which can leave a very dull, rounded edge configuration.

This particularly effective cross grind manual sharpener configuration as shown in FIG. 4, involves in one configuration a pair of small individually shaped truncated cone shaped rotatable abrasive coated disks 16 mounted on a common rotating shaft 18 whose axis is set at angle β, about 70-80 degrees from the line direction of motion 26 of the guided knife edge. Thus the line of motion of the knife is set about 10-20 degrees from the normal (perpendicular) to the axis of rotation of the disks. Linear back and forth motions of the knife edge in contact with the abrasive disks drags against the abrasive coated surfaces causing the disks to rotate together in a manner such that the abrasive particles on their surfaces are forced to cross the edge at an angle preferably on the order of 30 to 60°. The abrasive of one wheel crosses the edge facet moving up into the edge as viewed on one side of the edge and moving down out of the edge if viewed on the other side of the edge as the knife is pulled and pushed back and forth across the disk abrasive surfaces. The abrading lines on opposing facets however are not parallel but cross and intersect in a crossing pattern at the edge. The grinding directions also reverse on each reverse stroke of the knife—which helps to minimize any burr along the edge. A pair of these abrasive covered disks arranged in opposition with their smaller end surfaces juxtaposed, as shown in FIG. 4, create crossed sharpening patterns at the edge of the facets and thus establish an optimized cross-grind edge configuration. The knife suitably guided between the pair of abrasive coated disks as it is moved manually in a back and forth motion along the knife edge line in contact with both disks as shown in FIG. 4 rotates the disks about their common supporting shaft and can cause the abrasion lines to cross the knife edge at about 45°, forming an excellent cross-grind pattern.

These inventors recognized a unique advantage of this manual sharpener design because of its aggressive abrading ability. This is the result of very large stresses created at the edge due to the twist or intended misalignment of the axis of the moving knife edge with the axis of the pair of cone shaped abrasive wheels. As the knife is moved back and forth in a line established by an appropriate knife guide, the edge is trying to wedge down into the V-shaped space created by geometry of the rotating cones. This wedging action resisted by the abrasive covered cones places an enormous stress at the edge itself trying to twist the cutting edge as metal is being removed on the one side of the edge in contact with the abrasive surfaced cone. This stress is sufficient to fracture seriously virtually all abrasives except diamonds, resulting in rapid deterioration of the abrasive and loss of perfection of the surface geometry of the cones in the surface areas encountered by the knife edge. Thus we found with any abrasives except diamonds the effectiveness of such sharpening geometries deteriorates rapidly—rendering this arrangement impractical for quality sharpening. With other abrasives, the deterioration with other abrasives leads in time to dulling the knives rather than sharpening them. Diamond abrasives were thus discovered to be critical for high performance of this unique manual sharpening means.

Multistage Configurations to Create the Crossing-Grind Edge

These inventors have demonstrated a family of highly efficient knife sharpeners employing the novel annular abrasive disks geometry to create the cross-grind pattern along the cutting edge. These can as described be single stage, two stage, or three stage in design, the multiple stage configurations offering sharper more durable edges. Single stage designs are lower in cost but a forced compromise is required involving grit size of the abrasive between speed of sharpening and the obtainable sharpness. Multiple stages allow coarser grits to be used in the first stage for speed, followed by finer grits at larger angles to increase the edge sharpness and durability.

For single stage configurations a power driven stage is optimal. Two stage configurations can be solely electrically powered or the second stage using finer grit can be manual.

For three stage configurations the first stage is ideally power driven, but subsequent stages can be either manual or powered depending on cost considerations. The first stage must however be sufficiently aggressive that the primary facet is fully formed at the primary angle which for European American knives is about 20° degrees. Subsequent stages can with less aggressive abrasives easily form the cross-grind at the secondary bevels but only if the primary bevel has been fully formed. For best results diamonds have proven to be the ideal abrasive because of their ability to create well defined sharper flutes along the sharpened grooves that are ground by motion of the individual abrasive diamond crystals.

Where it is desired to construct a single stage sharpener to create quickly an efficient cross-grind edge, one can use a pair of right and left described novel powered configurations including a pair of annular abrasive disks. That creates the edge fast and it has the favorable cross-grind edge configuration. The powered disks can be either a) an annular ring, abrasive coated, and rotated about its center, b) a flat disk with the abrasive coating formed as an annular ring, or c) a flat disk fully coated with abrasive particles rotated about its center. However the fully coated disk is less efficient because near the center line of the disk the rotating abrasive particles are moving parallel to the edge line. However as the edge enters and leaves the rotating disk surface the abrasive is moving optimally across the edge line in different directions as described. It is possible to use either individual disk restraining springs for each disk or to use multiple disks on a common shaft that is spring restrained to control and limit the abrading force as the disks are displaced. In general individual spring control of each stage is to be preferred.

Two stage sharpeners can have a second stage that creates a finer, cross-grind configuration at the edge. The second stage can be either powered or manual.

A three stage configuration allows the use of a coarser grit in Stage 1 for faster sharpening to shape the initial facets quickly. The second and third stages can be either powered or manual and use finer grits to refine the edge sharpness while retaining the cross-grind configuration on the knife edge.

Example of Advanced Sharpener Design to Create Cross-Grind Edges

Figure 5:
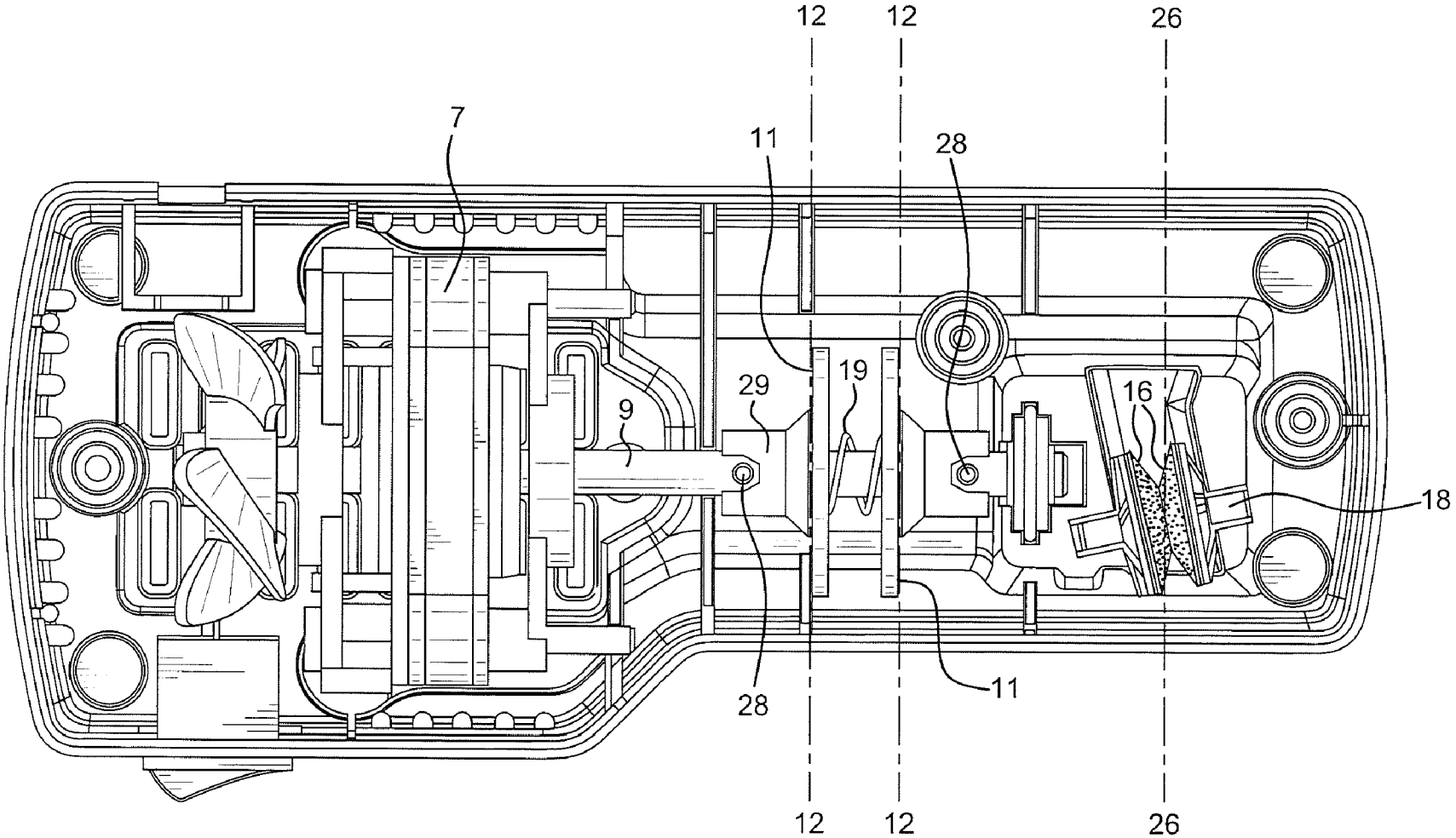
FIG. 5 is a top plan view of a multi-stage sharpener in accordance with this invention.
Figure 6:
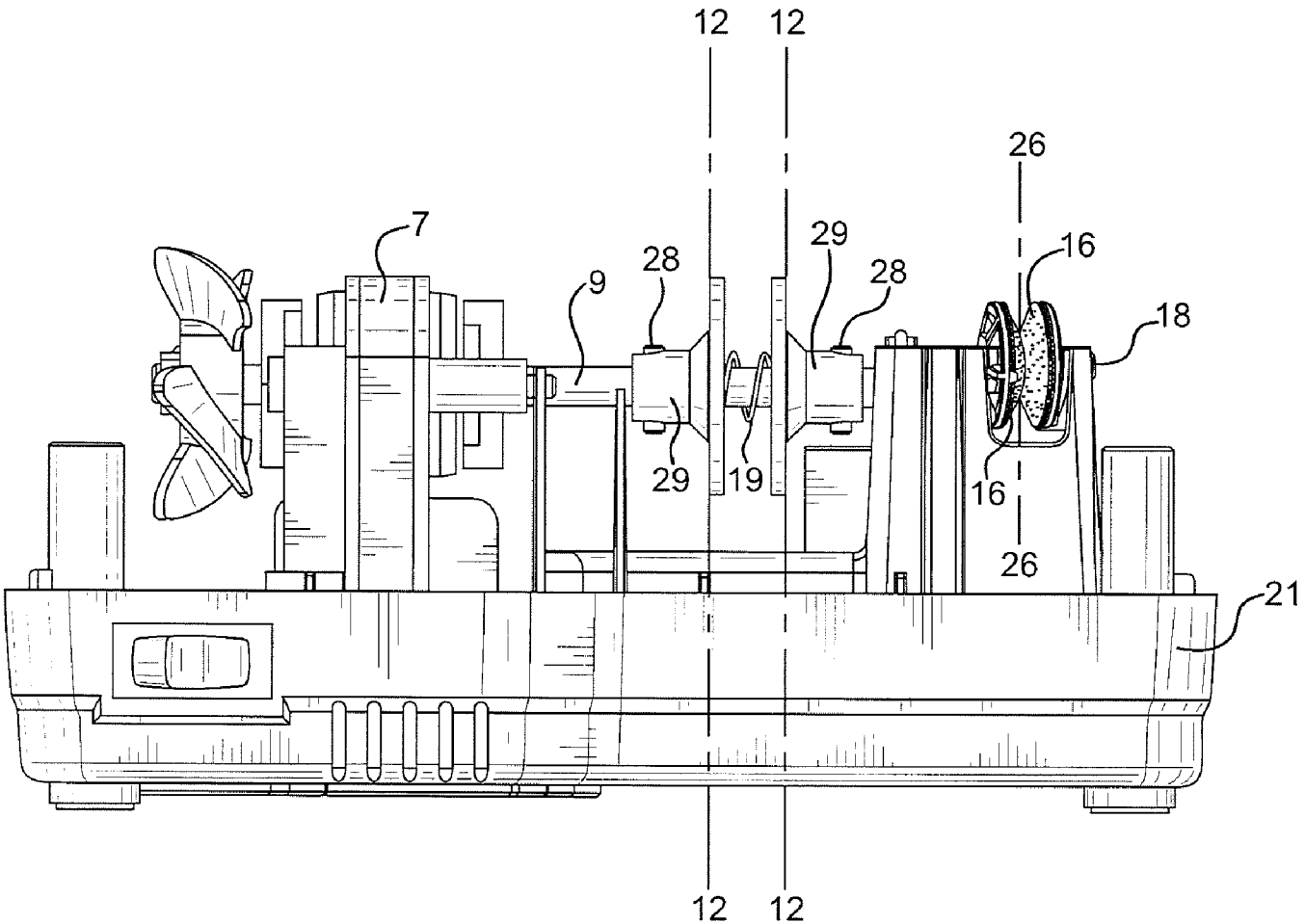
FIG. 6 is an elevation view of the sharpener of FIG. 5.
Figure 7:
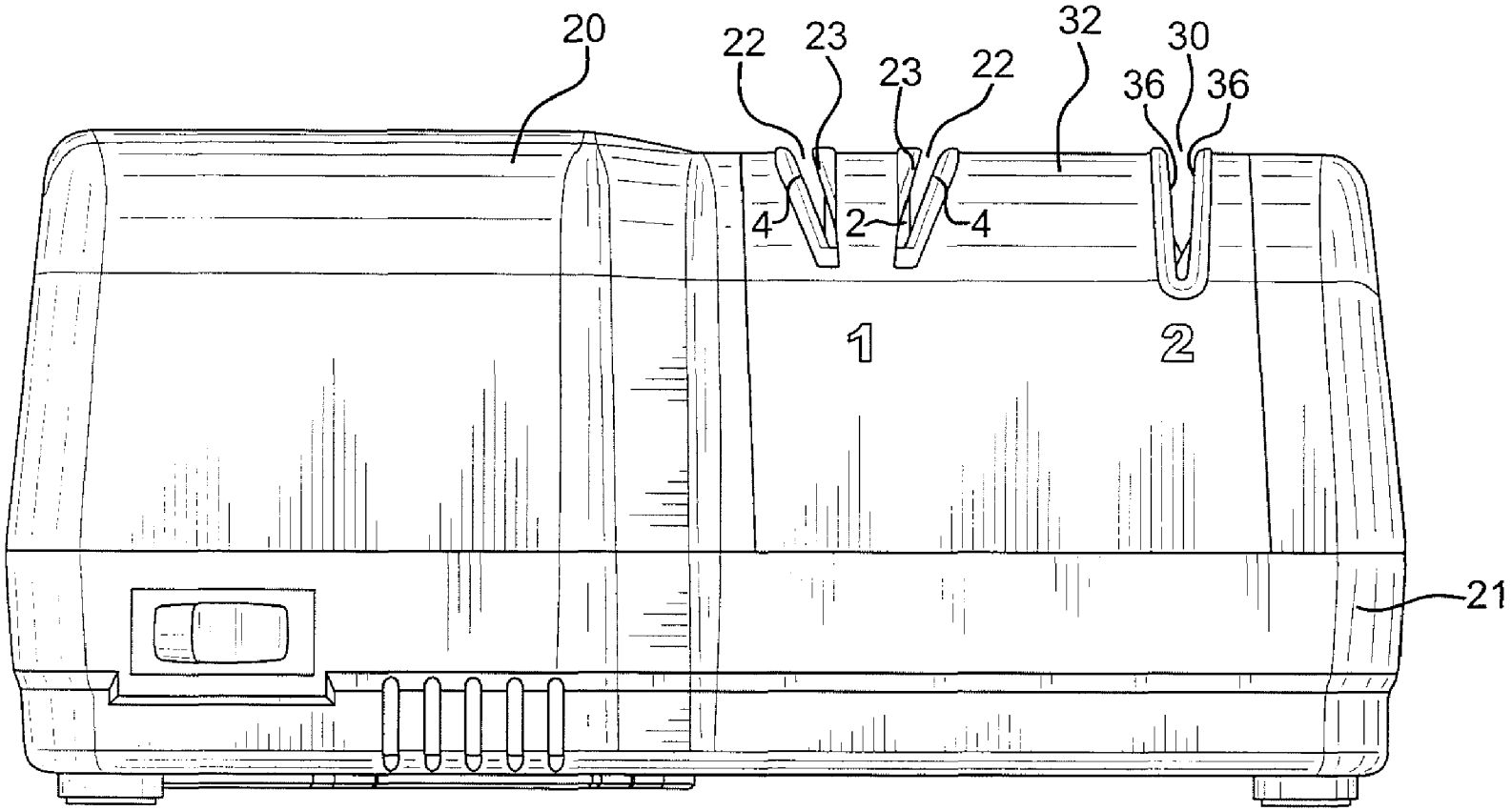
FIG. 7 is an elevation view of the sharpener of FIGS. 5-6 having a cover.

An example of the two stage sharpener that incorporates this new technology is shown in FIGS. 5, 6 and 7. These show the motor 7 that drives shaft 9 on which is mounted slidingly two planar abrasive surfaced disks 11 constituting Stage 1. Lines 12/12 are the path of the knife edge when sharpening in this stage with the abrasive on that side of the disks. The disks are mounted on a plastic support structure 29 driven by pin 28 but allowed to slide on shaft 9 when displaced by the knife. The knife guides are integral in this example with the cover as shown in FIG. 7. Knife guides 4 mounted within the cover 20 of the sharpener (FIG. 7) control the sharpening angular relationship between the knife edge facet and the powered abrasive elements as the knife edge is drawn and pushed sequentially through the two slots 22,22 of Stage 1 along the 12/12 direction shown. The cover 20 fits over the base 21.

The second stage of this sharpener for illustration is the manual configuration which is shown in greater detail in FIG. 4. The knife is pushed and pulled sequentially by hand through this right hand stage 2 of the sharpener of FIGS. 5, 6, and 7 by insertion in the slot 30 of FIG. 7. Each of the two knife facets are sharpened simultaneously during each pushing or pulling stroke of the blade thru that slot 30. The blade remains essentially vertical in this manual configuration as its facets are sharpened. The knife edge is thus moved along line 26/26 of FIGS. 5 and 6 as it is sharpened. The knife is guided in slot 30 as shown on cover 20, FIG. 7. The precise guiding of the knife is achieved by knife guide 36,36 located parallel to line 26/26 which is at the angle β, preferably approximately 70-80 degrees relative to the axis of the common shaft of the sharpening elements 16,16. Thus, the knife is sharpened by the rotating conical surfaces of sharpening elements 16,16 which abrade the facets as the knife is moved back and forth in guide 36,36.

In Stage 1 on the left of FIGS. 5, 6 and 7 the two flat disks 11 are fixed in position until displaced by the knife as it is inserted in the sharpener. As a disk is displaced against the restraining force of the spring 19 (FIGS. 5-6) the edge facet is sharpened as described with cross-grind patterns on that facet of the edge. In stage two the cross-grind edge is formed by the grind lines which although on different sides of the edge do cross at the edge, forming this effective edge structure.

As described earlier the two stages could alternatively both be powered and very similar in design to Stage 1.

In a three stage configuration all three stages could be powered and designed similarly to Stage 1 as described. Alternatively the second and third stages could be manual and be very similar in design to the stage two of FIGS. 5, 6 and 7, but these stages 2 and 3 would preferably be set to sharpen at different angles with progressively finer abrasives.

FIG. 7 shows the exterior of this two stage (one stage electric, the second manual) hybrid sharpener where an external decorative metal sleeve 32 establishes the boundaries of the knife slots 22 with the unique sections 24 (FIG. 3A) that act to limit the downward travel of the knife blade in the slot as it presses against and displaces the abrading disk. Slot 30 is also in sleeve 32. The knife guides 36,36 of FIG. 7 may be plastic. However, slot 30 of metallic sleeve 32 can alternatively serve as the knife guides.

What is claimed is:

1. An electrical sharpener for a knife that has at least one cutting edge facet adjacent the knife face, said sharpener comprising an enclosing base and cover structure, at least one knife angle guiding slot in said cover structure with first and second knife guiding walls extending downwardly from the top surface of said cover structure, an electrically powered motor, a nominally flat abrasive surfaced disk on a motor driven shaft, said disk held in a rest position by force of a spring yet slidingly displaceable when contacted by insertion of the knife into the knife angle guiding slot, said first guiding wall of said guiding slot comprising a guide surface against which the knife face would be placed during insertion of the knife into said guiding slot, said second guiding wall of said guiding slot having stop structure at a location inwardly of said top surface of said cover structure to contact a shoulder of the knife facet and prevent further insertion of the knife into said guiding slot whereby the lateral displacement of said disk is limited by the physical contact of the shoulder of the knife facet with said stop structure of said second guiding wall of the knife guiding slot and without contact of the cutting edge with any of the guiding wall structure.

2. The sharpener of claim 1 where said cover structure includes a metallic cover.

3. The sharpener of claim 1 where said first guiding wall of said knife angle guiding slot is defined by a planar surface designed for sliding contact with the face of said knife.

4. An electrical sharpener for a knife that has at least one cutting edge facet adjacent the knife face, said sharpener comprising an enclosing base and cover structure, at least one knife angle guiding slot with first and second knife guiding walls, an electrically powered motor, a nominally flat abrasive surfaced disk on a motor driven shaft, said disk held in a rest position by force of a spring yet slidingly displaceable when contacted by insertion of the knife into the knife angle guiding slot, the lateral displacement of said disk being limited by physical contact of the shoulder of the knife facet with the second guiding wall of the knife guiding slot and without contact of the cutting edge with any of the guiding wall structure; where said sharpener is an electrical stage of a combination electrical and manual sharpener having said electrical stage and having a manual stage, said manual stage comprising two truncated cone shaped sharpening elements and a knife guide, said truncated cone shaped sharpening elements being abrasive coated and mounted rigidly along their central axis on a common freely rotatable shaft with their smaller end surfaces juxtaposed, and said knife guide being positioned to align the line of knife edge motion at an angle to the axis of said rotatable shaft.

5. An electrical knife sharpener for a knife blade with at least one edge facet adjacent the knife face and its cutting edge, said sharpener comprising an electrical motor, a rotating nominally planar annular abrasive surfaced disk on a motor driven shaft, a knife angle guide to support the knife blade and position its edge facet at precisely the correct angle in contact with the surface of said annular abrasive disk as the knife edge facet is drawn across the rotating abrasive sections of said disk that will create a flat edge facet by contacting first on that area of the disk that grinds in a direction into the line of the cutting edge followed by grinding on that area that grinds in a direction out of the cutting edge being formed; where said sharpener is an electrical stage of a combination electrical and manual sharpener having said electrical stage and having a manual stage, said manual stage comprising two truncated cone shaped sharpening elements and a knife guide, said truncated cone shaped sharpening elements being abrasive coated and mounted rigidly along their central axis on a common freely rotatable shaft with their smaller end surfaces juxtaposed, and said knife guide being positioned to align the line of knife edge motion at an angle to the axis of said rotatable shaft.

6. The sharpener of claim 4 wherein said angle of said knife guide being positioned to align the line of knife edge motion is approximately 70-80 degrees.

7. The sharpener of claim 4 wherein said truncated cone shaped sharpening elements are coated with diamond abrasive.

8. The sharpener of claim 5 wherein said angle of said knife guide being positioned to align the line of knife edge motion is approximately 70-80 degrees.

9. The sharpener of claim 5 wherein said truncated cone shaped sharpening elements are coated with diamond abrasive.

* * * * *